US006423371B1

(12) United States Patent
Nesbitt

(10) Patent No.: US 6,423,371 B1
(45) Date of Patent: Jul. 23, 2002

(54) APPARATUS AND METHOD FOR FORMING A BONDING ON A TAPERED PART

(76) Inventor: Bruce M. Nesbitt, 233 E. Wacker Dr., Unit 4713, Chicago, IL (US) 60601

( * ) Notice: Subject to any disclaimer, the term of this patent is extended or adjusted under 35 U.S.C. 154(b) by 0 days.

(21) Appl. No.: 09/782,695

(22) Filed: Feb. 13, 2001

(51) Int. Cl.[7] ..... B05D 5/00; B05D 7/22

(52) U.S. Cl. ..... 427/233; 427/236; 427/256; 427/421; 427/424

(58) Field of Search ..... 427/8, 476, 181, 427/182, 183, 231, 233, 234, 236, 256, 287, 288, 240, 424, 425, 421

(56) References Cited

U.S. PATENT DOCUMENTS

| | | | | |
|---|---|---|---|---|
| 2,124,853 | A | | 7/1938 | Grupe |
| 3,904,930 | A | | 9/1975 | Waldron et al. |
| 4,049,842 | A | | 9/1977 | Gerek et al. |
| 4,138,284 | A | * | 2/1979 | Postupack |
| 4,313,981 | A | * | 2/1982 | Namiki |
| 4,687,531 | A | | 8/1987 | Potoczky |
| 4,866,241 | A | | 9/1989 | Doherty et al. |
| 5,281,446 | A | | 1/1994 | Matheson et al. |
| 5,456,754 | A | | 10/1995 | Matheson et al. |
| 5,922,412 | A | | 7/1999 | Baughman et al. |
| 6,019,845 | A | | 2/2000 | Nakakoshi |
| 6,042,885 | A | | 3/2000 | Woolard et al. |
| 6,093,449 | A | | 7/2000 | Carter, Jr. et al. |

FOREIGN PATENT DOCUMENTS

| | | | |
|---|---|---|---|
| JP | 11-244773 | * | 9/1999 |

* cited by examiner

*Primary Examiner*—Fred J. Parker
(74) *Attorney, Agent, or Firm*—Bell, Boyd & Lloyd LLC

(57) ABSTRACT

A method for forming a bonding on a tapered surface of a wall of a part to substantially eliminate the tapered surface. The method includes positioning the part and a sprayer at a predetermined distance, supplying a bonding material to the sprayer, and applying differing amounts of the bonding material from the sprayer to the tapered surface of the wall of the part to change the tapered surface of the wall of the part to a substantially non-tapered surface.

57 Claims, 8 Drawing Sheets

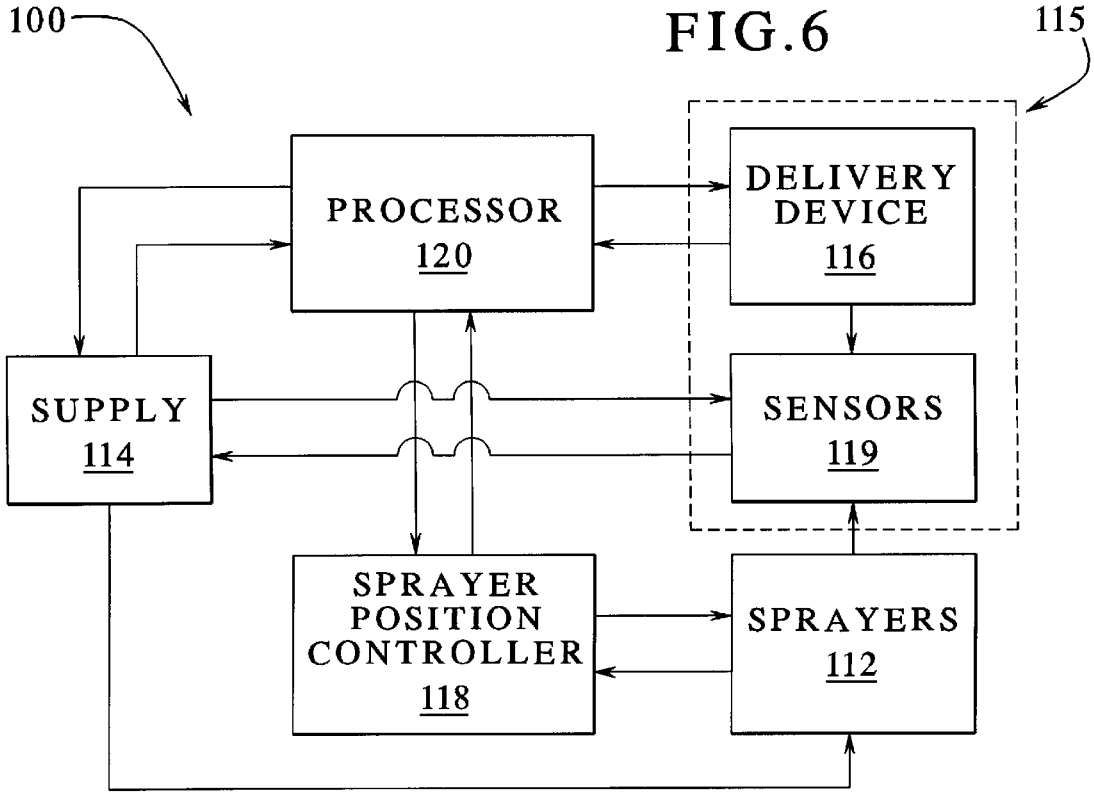
FIG.6
FIG.10A
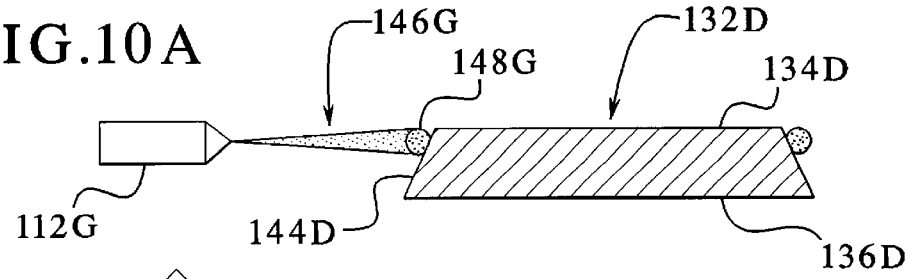
FIG.10B
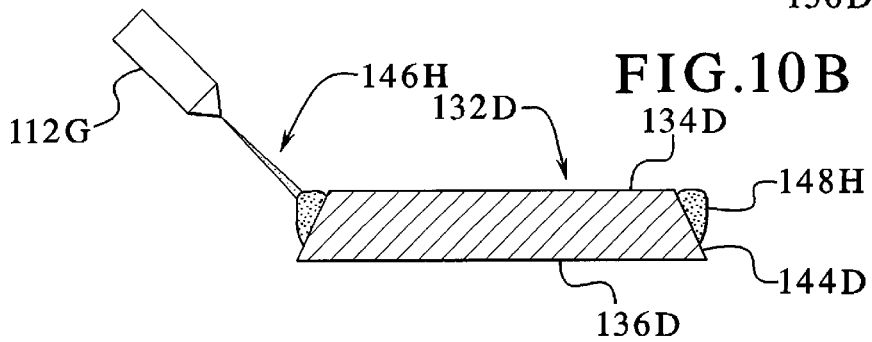
FIG.10C
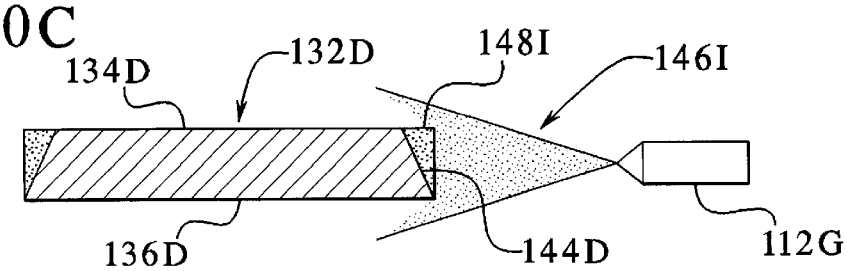

APPARATUS AND METHOD FOR FORMING A BONDING ON A TAPERED PART

DESCRIPTION

The present invention relates in general to an apparatus and method for bonding a material to a molded, cast, forged or machined part which has a tapered or angled portion or surface to dimensionally correct, define, re-define or otherwise alter the dimensions of the part and particularly the tapered or angled portion or surface.

BACKGROUND OF THE INVENTION

A number of assemblies and machines use molded, cast, forged or machined parts with apertures wherein the aperture passes at least partially or totally through the part. For example, a part used in processing equipment may have an aperture adapted to receive a roller. Certain known molding, casting, forging or machining techniques require forming the part with the aperture having an angled or tapered wall. If this wall is not altered or straightened prior to use, the roller in the above example only engages the narrowest portion of the part. This can cause excessive wear on that portion of the part, the roller or some other part in the processing equipment.

To solve this problem, conventional manufacturing processes form the part with a smaller aperture then needed and then mill, drill or machine the part to correct the dimensions of the aperture to form a larger purchase area or engagement surface. In some applications, a friction reducing material is coated on the inside tapered surface of such parts to decrease friction between the surface and a roller or other device engaging such surface. However, such coatings do not change the angle of the surface of such aperture to increase the purchase area.

Other parts are manufactured with an angled or tapered outer surface. Accordingly, there is a need for an apparatus and method for dimensionally changing the angled or tapered surface of such parts.

SUMMARY OF THE INVENTION

The present invention solves the above problem by correcting or otherwise altering the dimensions of a part. More specifically, the present invention provides an apparatus and method for bonding a material to a molded, cast, forged, machined or otherwise formed part having an angled surface or portion such as a tapered aperture to dimensionally correct, define, re-define or otherwise alter the part's dimensions and specifically the angled surface or portion of the part. For purposes of this application, the term "part" includes any molded, cast, forged, machined or otherwise formed part or workpiece.

The apparatus of the present invention preferably includes: (i) a sprayer; (ii) a bonding material delivery system or supply; (iii) a part rotating support, turntable, moving mandrel or other spinning or part moving apparatus; (iv) a sprayer positioner or sprayer positioning controller; and (v) a processor that simultaneously operates the sprayer, the supply, the sprayer positioning controller and the rotating support in concert. The apparatus uses the sprayer, the supply, the sprayer positioning controller, and the rotating support, as controlled by the processor, to bond a suitable bonding material (alternatively referred to as "material") to the part to meet the specifications of the manufacturer or ultimate user of the part.

In one embodiment for a part having a tapered aperture, the sprayer is inserted into the center of the angled or tapered aperture, preferably equally spaced from the inner surface or wall. The support holds and spins the part during the bonding process so that the material is bonded to the entire surface of the wall of the aperture. The sprayer applies bonding material at a predetermined spray rate, but moves at a differentiating withdrawal rate (i.e., the withdrawal rate decreases or slows as the sprayer is withdrawn from the aperture). As a result, more material is bonded to the tapered wall as the sprayer is withdrawn. This results in a cylindrical aperture having a straight or substantially straight wall with a predefined circumference.

In another embodiment of the present invention for a part having a tapered aperture, the sprayer is aimed towards the surface of the angled wall of the tapered aperture while the support spins the part. The sprayer is aimed at the inner surface at a predetermined angle. The sprayer has a predetermined spray rate, a spray cone of predetermined dimensions and a predetermined movement rate. As the sprayer moves relative to the aperture, the sprayer applies the bonding material to the wall of the aperture. The spray rate and movement of the sprayer are consistent throughout the process. This results in a cylindrical aperture with a straight or substantially straight wall having a predefined circumference.

Both alternative embodiments may also be employed to alter the angle of an outer wall of a part. It should also be appreciated that multiple sprayers may be used in accordance with the present invention.

Accordingly, the present invention provides a method for changing an angled surface of a part which includes positioning a part and a sprayer in relatively close proximity, supplying a bonding material to the sprayer and applying differing amounts of the bonding material to the angled surface of the part. The method further preferably includes rotating the part or the sprayer and moving the part relative to the sprayer or moving the sprayer relative to the part.

A further embodiment of the method of the present invention includes applying a bonding material to an angled surface of a part to alter the angled surface by moving the part, determining the placement of the part using a sensor adapted to communicate with a processor, selecting at least one sprayer from a plurality of sprayers based at least partly on the placement of the part and applying differing amounts of the bonding material to the angled surface of the moving part.

A still further embodiment of the method of the present invention includes altering an angled surface defining an aperture in a part by inserting a sprayer into the aperture in spaced relationship to the angled surface, withdrawing the sprayer from the aperture at a predetermined withdrawal rate and applying differing amounts of a bonding material to the angled surface using the sprayer, thereby altering the angled surface. This method includes withdrawing the sprayer from the aperture at a variable rate and particularly withdrawing the sprayer at a decreasing rate.

A yet further embodiment of the method of the present invention includes altering an angled surface defining an aperture in a part by positioning a sprayer with respect to a plane defined relative to a surface of the part, rotating the part, moving the sprayer along the plane at a predetermined rate and applying differing amounts of a bonding material to the angled surface, thereby altering the angled surface.

It is therefore an advantage of the present invention to provide an apparatus for bonding a material to a part having an angled surface.

A further advantage of the present invention is to provide a method for bonding a material to a part having a tapered aperture to alter the dimensions of the aperture.

Other objects, features and advantages of the invention will be apparent from the following detailed disclosure, taken in conjunction with the accompanying sheets of drawings, wherein like numerals refer to like parts, elements, components, steps and processes.

BRIEF DESCRIPTION OF THE DRAWINGS

FIG. 6. is a block diagram of an alternative embodiment of the apparatus of the present invention;

FIGS. 10A, 10B and 10C are elevational views of an alternative embodiment of the part and sprayer of FIG. 7, illustrating the application of bonding material to an exterior surface of the part.

DETAILED DESCRIPTION OF THE INVENTION

Figure 1:
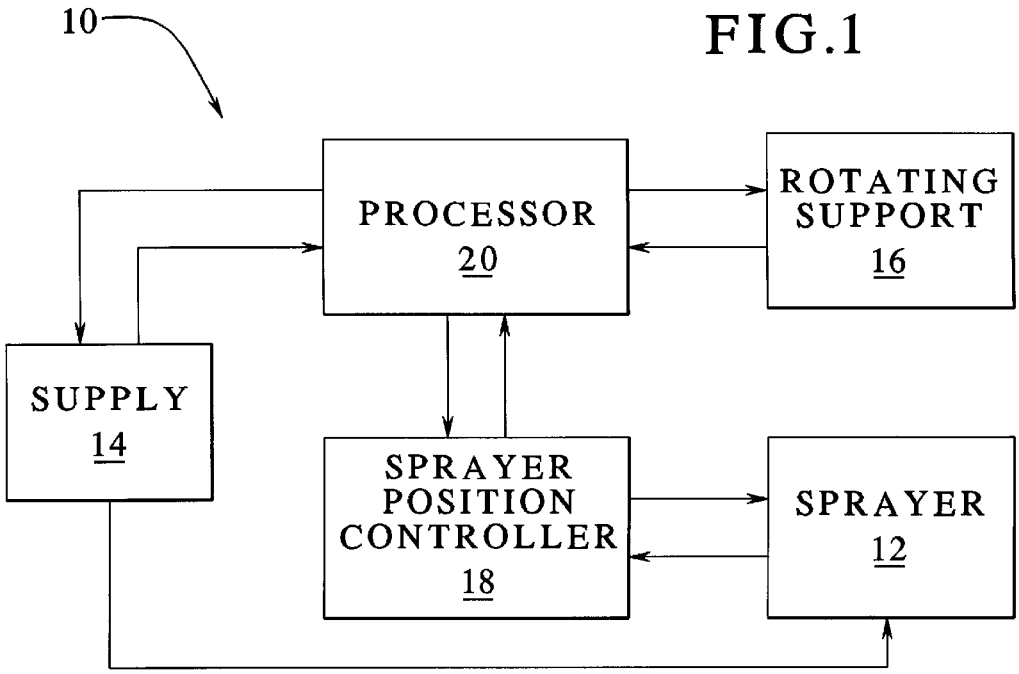
FIG. 1 is a block diagram of one embodiment of the apparatus of the present invention.

One preferred embodiment of the apparatus 10 of the present invention is illustrated in FIG. 1. The apparatus 10 bonds a material to a surface of a part such as an inner tapered or angled wall of a part to dimensionally change or alter the aperture of the part defined by the inner angled or tapered wall. It should be appreciated that the apparatus of the present invention is also adapted to be used to bond a material to any angled surface of a part including but not limited to an angled surface defined by an exterior surface of the part.

The apparatus 10 of the present invention preferably includes: (i) a spray nozzle, a spray gun or spray head (generally referred herein to as a sprayer 12); (ii) a bonding material delivery system or supply 14; (iii) a rotating support, turntable, moving mandrel or other spinning or part moving apparatus 16; (iv) a sprayer positioner or sprayer positioning controller 18; and (v) a processor 20 that simultaneously operates the sprayer 12, the supply 14, the sprayer positioning controller 18 and the rotating support 16 in concert. The apparatus 10 uses the sprayer, the supply, the sprayer positioning controller and the rotating support, as controlled by the processor, to bond a bonding material to the part to dimensionally change or alter the portion of the part defined by the angled or tapered wall (i.e., such as an inner aperture) in accordance with the specifications of the manufacturer or user of the part.

The sprayer 12 of the present invention distributes the material in a controlled manner to avoid waste, and in particular to avoid waste due to over-spray of the part. The sprayer 12 preferably includes a conventional spray housing 22, a conventional distributor or nozzle 24A or 24B (best viewed in FIGS. 4A, 4B, 4C, 5A, 5B and 5C) and a conventional valve (not shown) contained in the spray housing 22 which is connected to the supply 14 and processor 20. A tube or other conduit 26 is connected to the sprayer and the supply, enabling the apparatus 10 to distribute the bonding material in one or more repeatable predetermined spray patterns.

The valve and distributor communicate with the processor 20, responding to on and off or proportional command signals, controlling the timing and extent of valve operation and the timing, direction and motion of the distributor. The distributor provides the material with a spray pattern suitable for applying the material to the angled surface or wall of the part. In a preferred embodiment, the sprayer has a predetermined spray rate, a spraycone of predetermined dimensions and a predetermined movement rate. As the sprayer moves relative to the part, the sprayer applies the material to the tapered surface of the part as described in greater detail below.

In one embodiment, the distributor is fixed or stationary with respect to the spray housing. However, alternative embodiments of the present invention are contemplated in which the distributor moves with respect to the housing (i.e., the distributor can rotate with respect to the housing or change its angle with respect to a plane defined by the housing). The sprayer 12 may be adapted to communicate with the processor 20 to provide status signals including, for example, position signals or signals representing the quality and/or quantity of the material.

The supply 14 communicates with the processor 20 and is in fluid communication with the sprayer 12 through conduit 26. The supply provides a predetermined amount of bonding material in suitable quantities to the sprayer as determined by the processor. The material is preferably supplied as needed, eliminating storage of the material in the sprayer, thereby reducing sprayer waste.

In one preferred embodiment, the supply satisfies the preprocessing (i.e., storage and/or mixing) and transfer requirements of the material for particular applications. It should be appreciated that any suitable material, including low temperature cure resin formulations, lining material, bonding material such as adhesives, lubricants, seals, or other material, for example a fluoropolymer such as PTFE (Teflon®) are contemplated. Moreover, materials including augmenting agents, which include engineering fibers, filaments, metals, one or more coloring agents, corrosive resistant agents, wear proofing resistant agents, and temperature, pressure or other resistant agents are all contemplated for use with the present invention.

Preferably, the material is stored and used in apparatus 10 at a predetermined temperature and pressure appropriate for the material, and fed or supplied under pressure to the sprayer 12. The supply 14 responds to commands from the processor, providing operating status to the processor for safe and efficient operation. It should be appreciated that the supply may include a conventional displacement pump and conventional pressure regulator. The pump develops pressure between about five to about fifteen PSI. At some point in transport to the sprayer 12, the tubing 26 and material are regulated to a lower pressure between about one to about ten PSI.

The sprayer positioner or sprayer positioning controller 18 is connected to the sprayer 12 and communicates with the processor 20. The sprayer positioning controller controls the placement and motion of the sprayer, preferably by moving the sprayer with respect to the part as needed for a particular application. It should be appreciated that an application may include moving only the part, or only the sprayer or both for all of, or only a portion of, a particular application. It should further be appreciated that an application may include rotating the sprayer (or just the distributor or nozzle) for all of, or only a portion of, a particular application.

The sprayer positioning controller 18 may include any conventional object handling equipment such as hydraulic, pneumatic, conveying or sprayer positioning equipment, together with the necessary proximity sensors, limit switches, timers and/or motion/position monitoring equipment. It should be appreciated that in one alternative embodiment, the sprayer positioning controller could include robotic handling equipment. The sprayer positioning controller responds to rotate or move commands (at one or more fixed or variable speeds) issued by the processor, so that at least the sprayer 12 moves relative to the part and more particularly the angled wall of the part.

The sprayer positioning controller communicates mechanical status signals to the processor 20 such as direction and motion of the sprayer 12, and operating status signals such as power, fluid pressures, temperatures, etc. for safe and efficient sprayer position and control. It should also be appreciated that while the sprayer positioning controller is illustrated as one device, the sprayer positioning controller could include two or more devices.

In one embodiment, the sprayer positioning controller includes an actuator device 28 (best viewed in FIG. 3) connected to and actuating the sprayer and a sprayer positioning sensing assembly (not shown). Conventional techniques are used to obtain and control the ascent and descent speeds, lateral and/or transverse movement, the mechanical responsiveness and sprayer positioning accuracy and repeatability of the sprayer 12. In one preferred embodiment, the sprayer positioning controller moves the sprayer primarily along a vertical axis or line defined relative to the part. In one illustrated embodiment, the vertical axis is defined by a centerline of the aperture (best viewed in FIGS. 4A through 4D). An alternative embodiment is contemplated in which the sprayer is moved along a plane defined at an angle to the part, such as at an angle to a top surface or the inner wall of the part (best viewed in FIGS. 5A through 5D).

Processor 20 is connected to support 16 which connects to and supports the part in a moveable manner. The support generally is a rotating support, a turntable, a moving mandrel or any other suitable spinning or moving apparatus. The support is spun, rotated, moved or otherwise motivated by a conventional drive system (not shown) which includes a motor or other suitable activating device connected to and communicating with the processor. In an alternative embodiment, the support communicates with the processor through the sprayer positioning controller.

Figure 3:
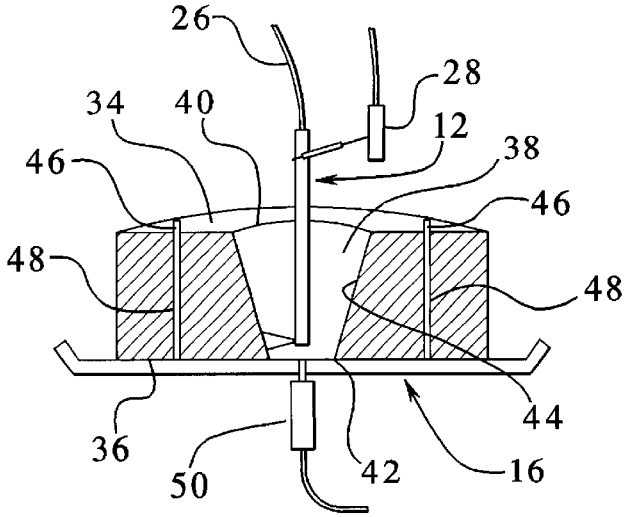
FIG. 3 is a cross-sectional view of the part of FIG. 2, and a schematic view of the rotating support, the sprayer and the sprayer positioner of one embodiment of the present invention.

In one preferred embodiment illustrated in FIG. 3, the support 16 is rotated about its central axis. Two suitable preforms or holding devices 48 are fixedly or removably mounted on the support to position and secure the part during the bonding process.

It should be appreciated that rotating or otherwise moving the part presents all faces of the tapered surface or wall to the sprayer, enabling the apparatus 10 to evenly bond the material thereto as required by the application. Rotating the support 16 and the part also imparts a centrifugal force on the sprayed material to assist in removing any gas bubbles. Furthermore, the centrifugal force on the material assists in the disbursement of the material on the part.

Figure 2:
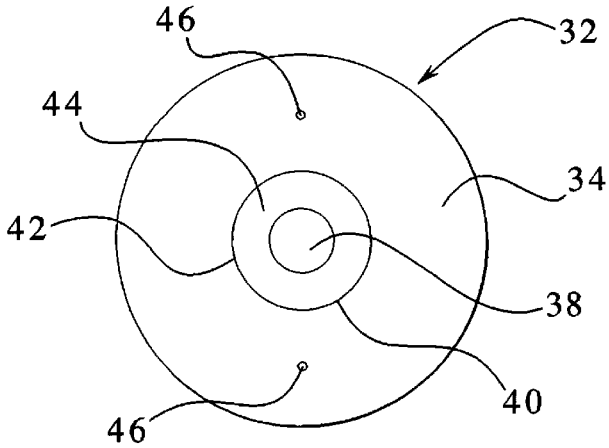
FIG. 2 is top plan view of a part having a tapered aperture.

Turning now to FIGS. 2 and 3, a sample part 32 having an angled or tapered wall which defines a central aperture is illustrated. It should be appreciated that this part is provided as an example only, and that the apparatus and method of the present invention are suitable for other parts having varying sizes and shapes. The illustrated cylindrical part includes opposed top and bottom (or first and second) surfaces 34 and 36, respectively. The part 32 has an angled or tapered inner wall or surface 44 which defines an aperture 38 extending between first and second surfaces 34 and 36 so that a first end or opening 40 of the aperture is defined at first surface 34 and a second end or opening 42 of the aperture is defined at the second surface 36. It should be appreciated that first end 40 has a predetermined diameter that is greater than the second end 42 so that the aperture 38 is tapered. In addition, the part 32 defines at least one, and preferably two or more positioning slots 46, adapted to removably receive the preforms or positioning devices 48 connected to the support 16.

One embodiment of the apparatus is further illustrated in FIG. 3. In this embodiment, the support is shown attached to a drive mechanism 50 and controlled by the processor. The part 32 is situated on the support 16 so that preferably positioning devices 48 engage slots 46. The sprayer 12 connected to the spray positioner 28 is adapted to be inserted into the aperture 38 for applying the material to the tapered inner surface 44.

Figure 4A:
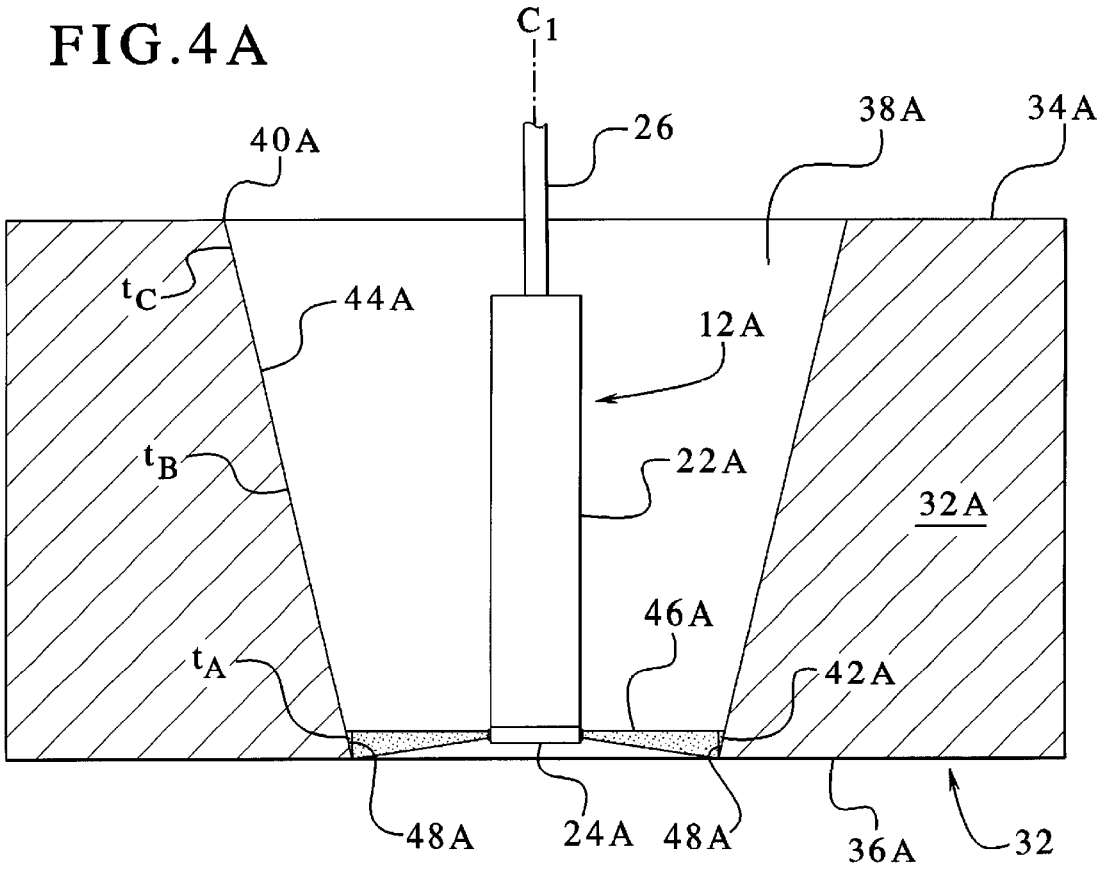
FIGS. 4A, 4B, 4C and 4D are enlarged cross-sectional views of the part and bonding apparatus of FIG. 3 illustrating the application of the bonding material to the angled or tapered surface of the part.

The application of the bonding material to the inner aperture of the part 32 by the apparatus 10 is illustrated in FIGS. 4A through 4D. The sprayer 12A is inserted into the aperture 38A, preferably equally spaced from the inner surface 44A of the aperture (i.e., along center line $C_1$) as illustrated in FIG. 4A. It should be appreciated that the support (not shown in FIGS. 4A to 4D) preferably spins the part 32A during the bonding process. Alternatively, both the part and the sprayer, or just the sprayer could rotate.

Figure 4D:
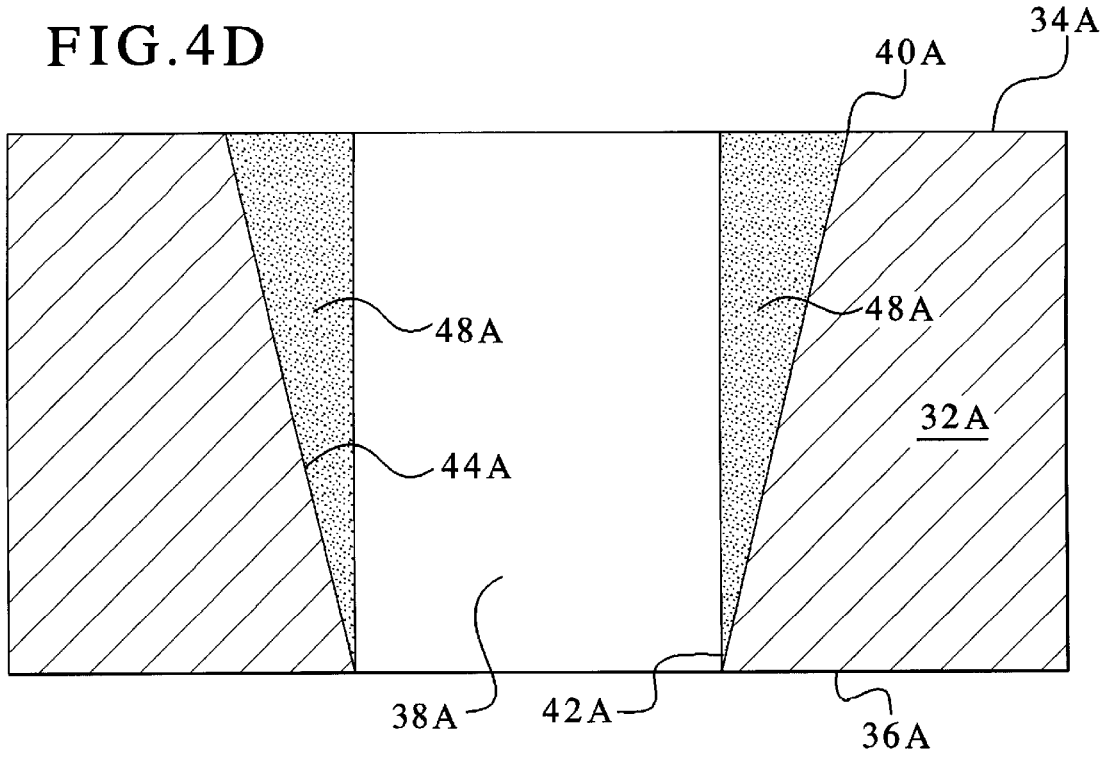
Figure 4B:
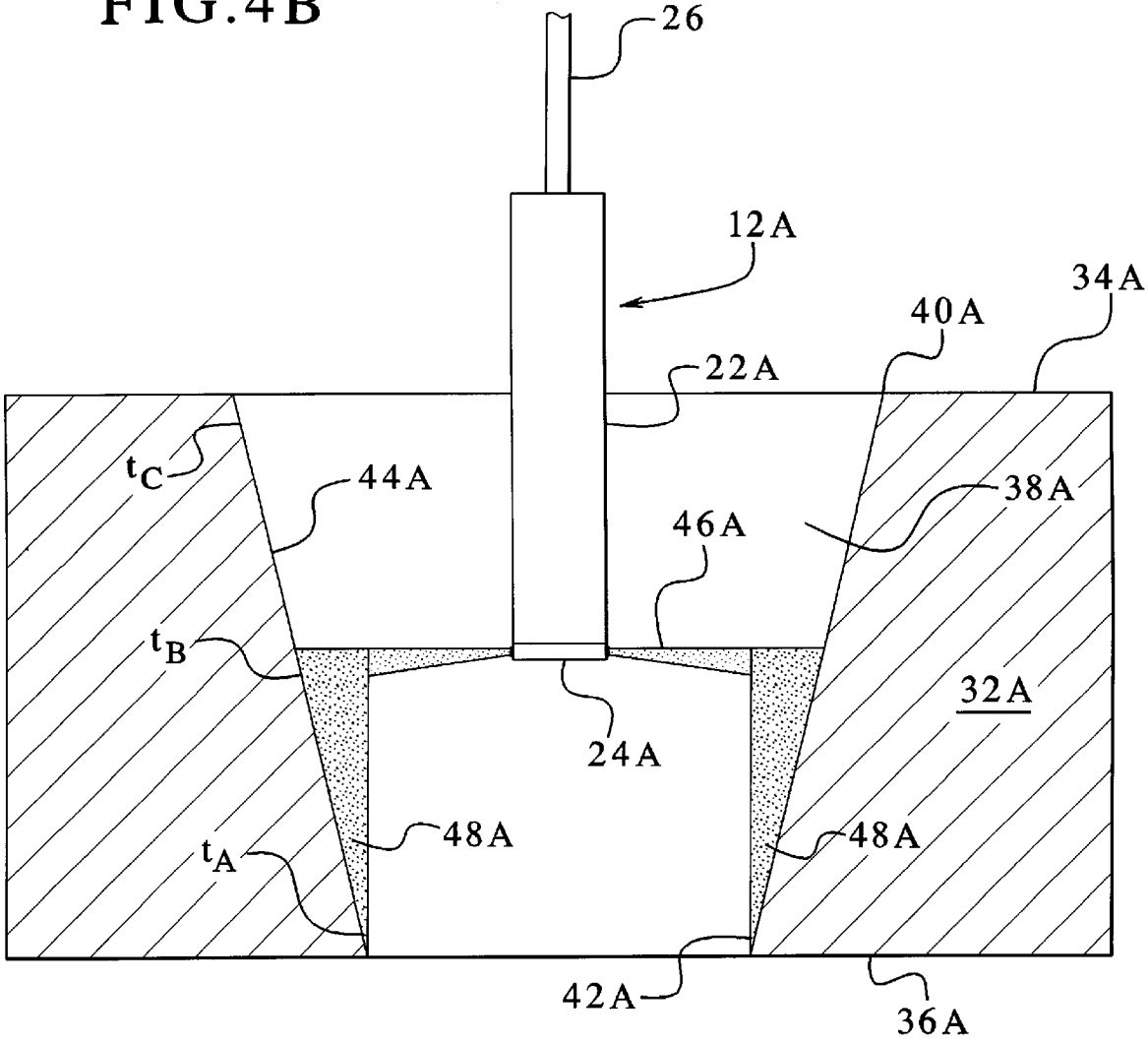
Figure 4C:
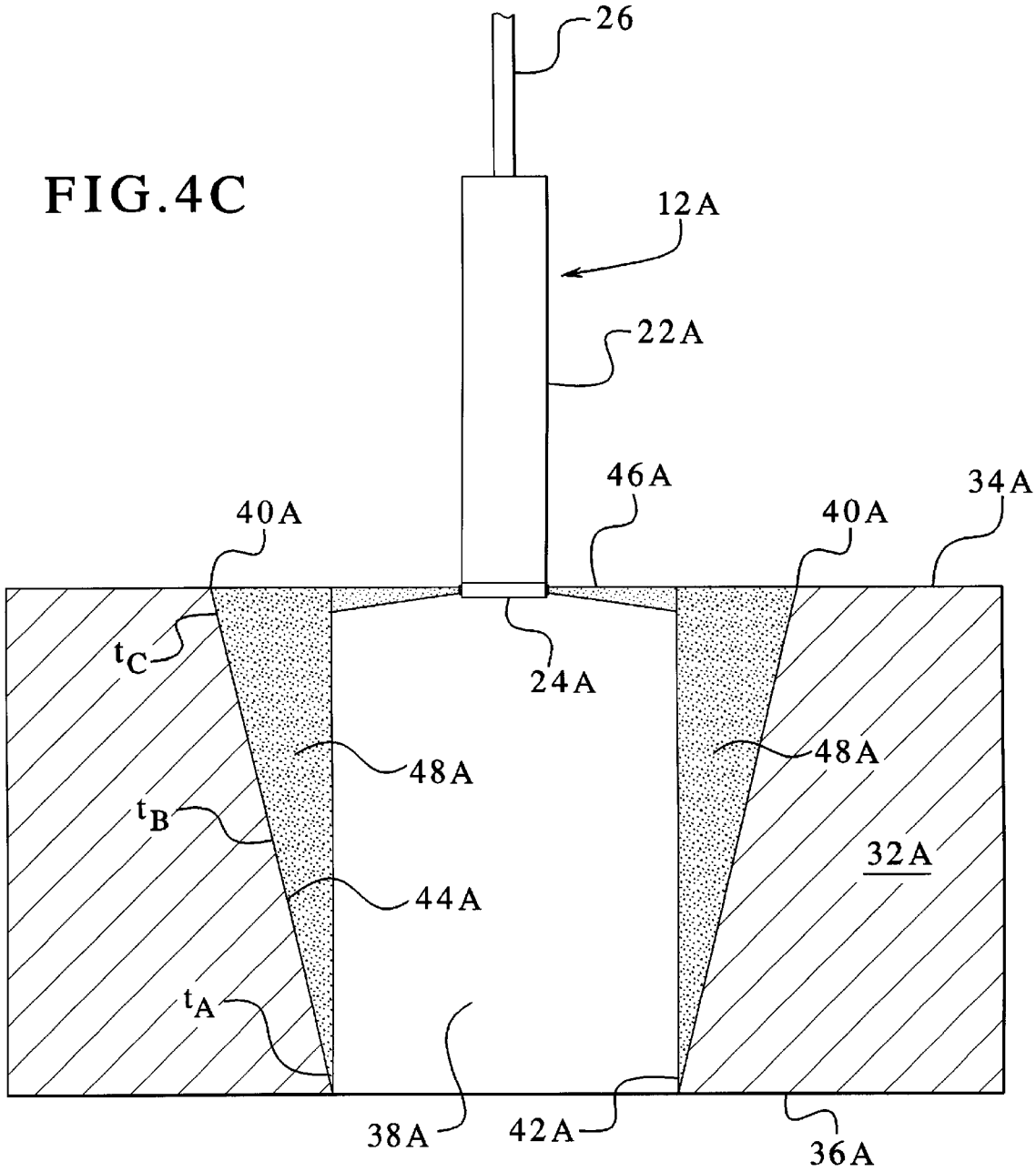

The sprayer 12A applies the material 48A at a predetermined spray rate throughout spraycone 46A. The sprayer 12A moves upwardly out of the aperture at a varying withdrawal rate (i.e., the withdrawal rate of the sprayer 12A changes as it is withdrawn from the aperture 38A). In the illustrated embodiment, the sprayer withdrawal rate decreases, slows or declines as the sprayer is withdrawn from the aperture to facilitate additional bonding material applied to the tapered wall 44A as the size of the aperture increases. For example, at point $t_A$ the withdrawal rate could be 10 millimeters per second, at point $t_B$8 millimeters per second and finally at point $t_C$6 millimeters per second. As a result, more material 48A is bonded to the inner surface 44A as the sprayer 12A is withdrawn as illustrated in FIGS. 4A through 4D. This results in a cylindrical aperture with a straight or substantially straight wall and a predefined circumference as illustrated in FIG. 4D.

In another embodiment illustrated in FIGS. 5A through 5D, sprayer 12B is aimed towards the inner surface 44B of the aperture. It should be understood that the support is again spinning the part 32B during the bonding process so that the material 32B is bonded to the entire inner surface 44B of the aperture 38B. The sprayer 12B is aimed at the inner surface at a predetermined angle to the inner surface and the part.

The sprayer has a predetermined spray rate, a spraycone 46B of predetermined dimensions and a predetermined movement rate. Sprayer 12B is moved along a plane defined by the part. In the illustrated embodiment, the plane is defined at an angle to the first surface 34B, so that sprayer moves in relation to the first surface.

Figure 5A:
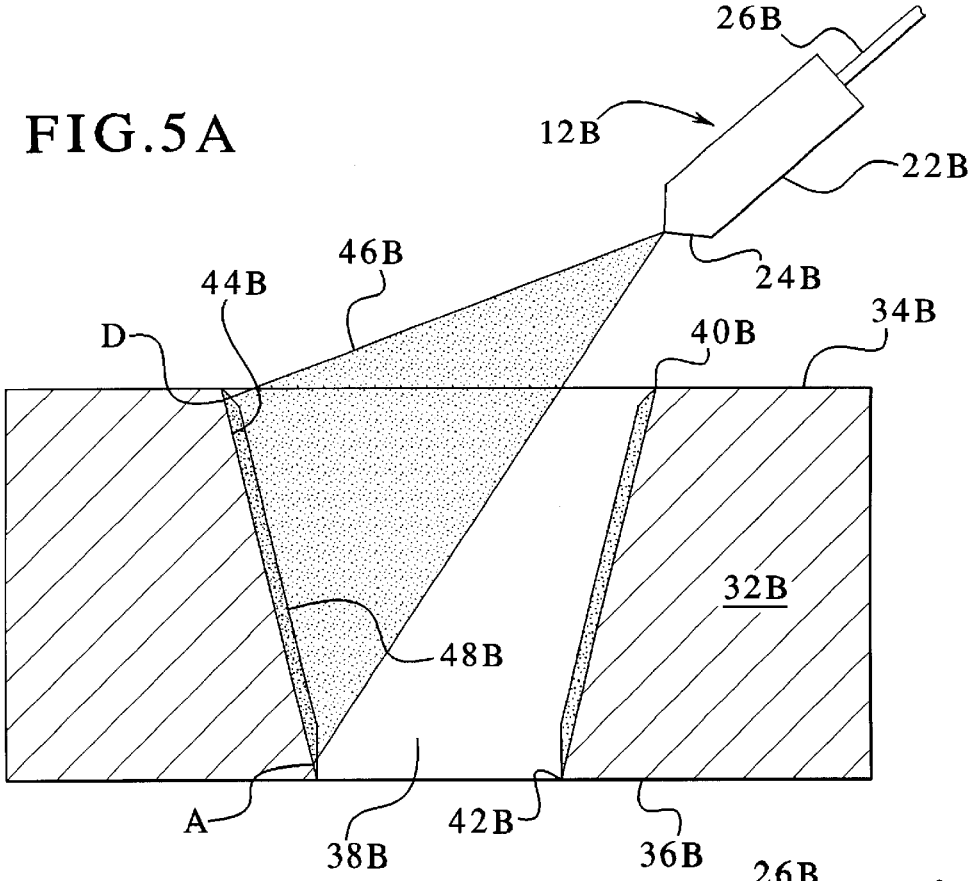
FIGS. 5A, 5B, 5C and 5D are enlarged partial cross-sectional views of the part and an alternative embodiment of the bonding apparatus of the present invention illustrating the application of the bonding material to the angled or tapered surface of the part.
Figure 5B:
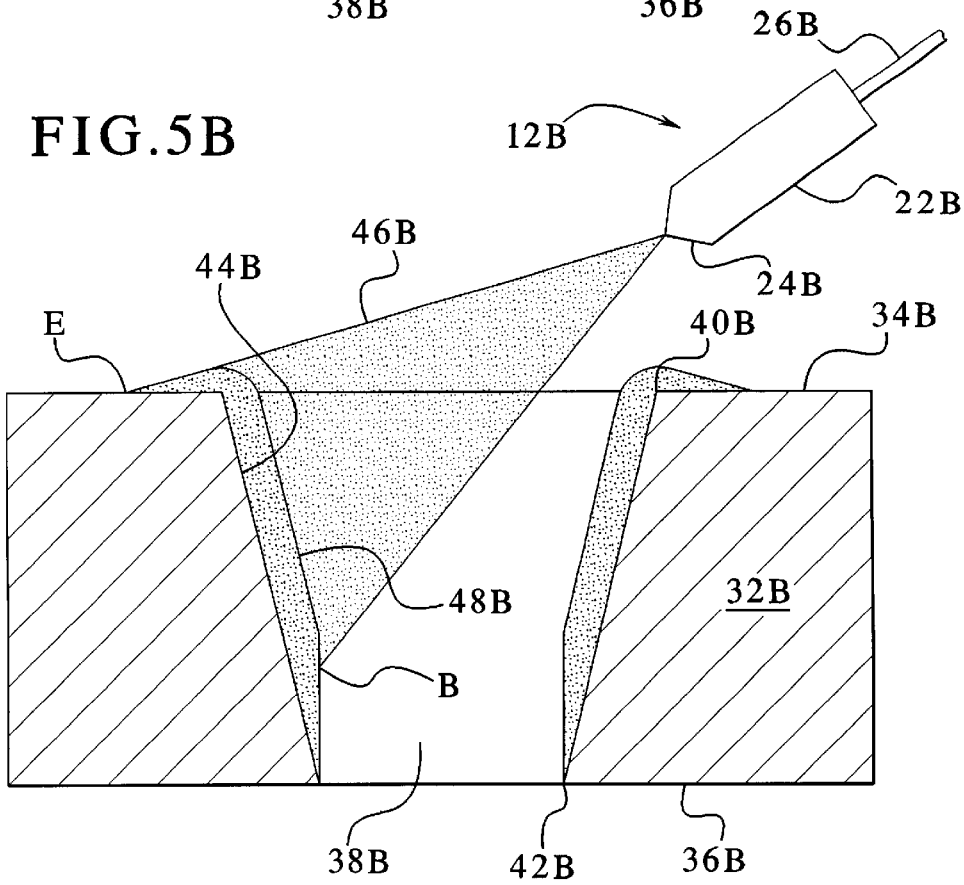
Figure 5C:
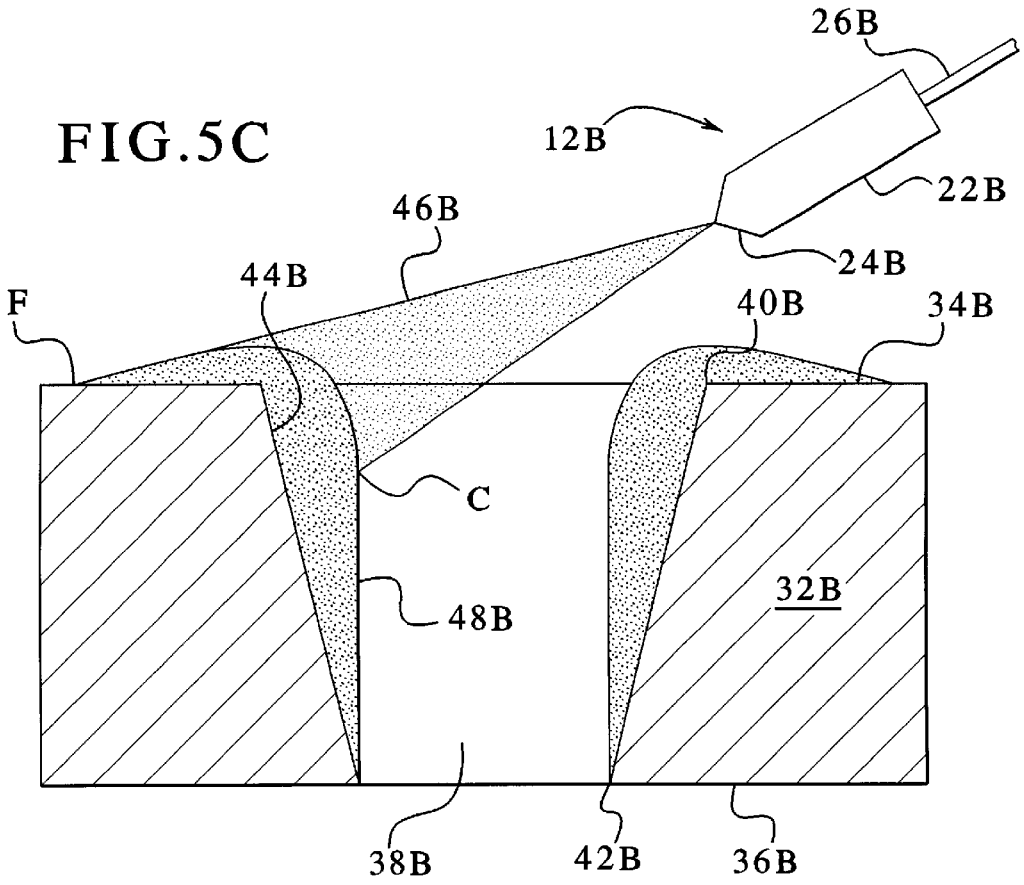
Figure 5D:
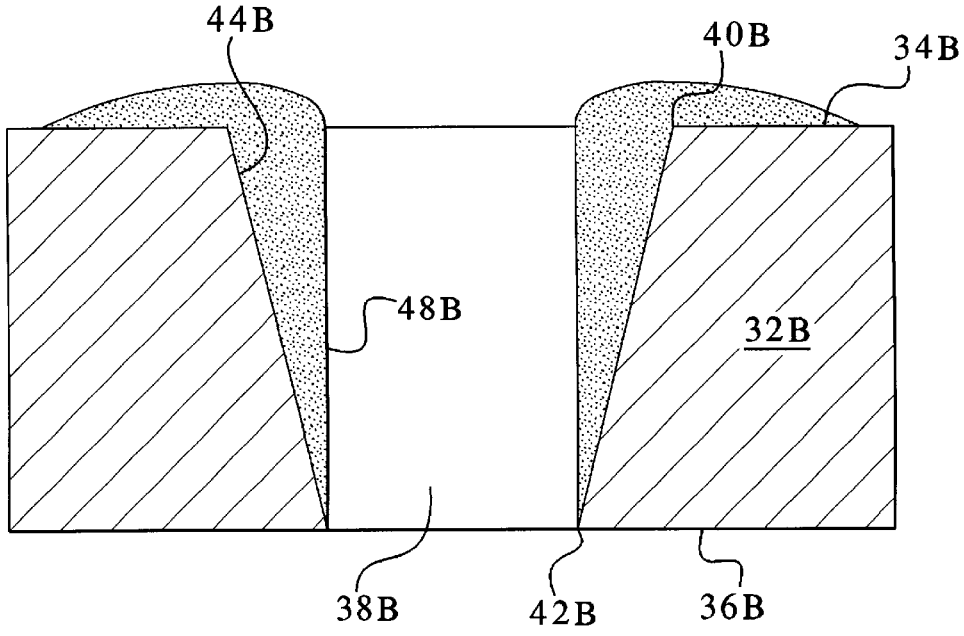

As the sprayer moves relative to the part, preferably moving along the defined plane at the predetermined movement rate, the spraycone 46B applies the bonding material to the inner surface. For example, in FIG. 5A spraycone bonds material to points A through D (and all points in between) at time $t_1$, while at time $t_2$ illustrated in FIG. 5B, the spraycone bonds material to points B through E (and all points in between). Points B through D are bonded at both $t_1$ and $t_2$, but point A doesn't receive any more material at time $t_2$ or thereafter. Finally, at time $t_3$ illustrated in FIG. 5C, the spraycone bonds material to points C through F. The amount of the bonding material on the inner surface increases as the sprayer moves along the defined plane. The spray rate and movement of the sprayer are consistent throughout the process of this embodiment. This results in cylindrical aperture having a generally straight wall with a predefined circumference as illustrated in FIG. 5D. As further illustrated in FIG. 5D, the bonded part will include an area of bonding material attached to the upper surface 34B. This material may be left on the part for certain uses of certain parts or may be removed by any suitable removal process such as filing, grinding, etc.

In a further alternative embodiment, two or more sprayers are contemplated for altering an angled surface of the part. In this embodiment, the two sprayers are offset or spaced from each other, so that a first sprayer having a predetermined spray rate through a spraycone is positioned relative to that portion of the part that requires the greatest alteration (i.e., that portion that requires the greatest amount of bonding material). A second sprayer, preferably having a predetermined spray rate through a spraycone different (generally greater or larger) than the first sprayer, is positioned relative to that portion of the part that requires the least alteration (i.e., the least amount of bonding material).

As the sprayers are moved or withdrawn, the first sprayer applies a comparatively small, predetermined amount of material (i.e., a small line or amount of material) to that portion of the angled surface requiring the greatest alteration. The second sprayer applies bonding material to a larger area of the angled surface (generally the entire angled surface), including at least some if not all of the portion of the surface already altered. It should be appreciated that three or more sprayers could be used in a similar fashion.

A further alternative embodiment of the apparatus of the present invention, generally designated 100, is illustrated in FIG. 6. This embodiment preferably includes: (i) a plurality of sprayers 112; (ii) supply 114; (iii) a part delivery system 115; (iv) sprayer positioning controller 118; and (v) a processor 120 that simultaneously controls the sprayers 112, the supply 114, the part delivery system 115 and the sprayer positioner controller 118. In one embodiment, the apparatus 100 applies the bonding material to the part to dimensionally alter an angled surface defined on an exterior portion of the part in accordance with the specifications of the manufacturer or user of the part.

In one preferred embodiment, processor 120 is connected to the part delivery system 115 which provides or delivers the parts to the sprayers, applying the bonding material. Preferably, the part delivery system 115 includes a rotating support 116 similar to that described above and a plurality of sensors 119. It should be appreciated that the delivery system may include a conveyor belt or other device (not shown) providing a plurality of parts to the rotating support 116 for alteration. The support is rotated or otherwise motivated by the conventional drive system similar to that described previously. Further, in addition to rotating the part, the drive mechanism may otherwise move the part with respect to the sprayers (vertically, horizontally or at some other plane thereto) so that more bonding material is applied to one portion of the angled surface than any other portion.

The sensors 119 are connected to the processor and determine the part's placement relative to the sprayers. The processor selects one or more sprayers from the plurality of sprayers to apply the bonding material to the part or portion thereof.

Figure 7:
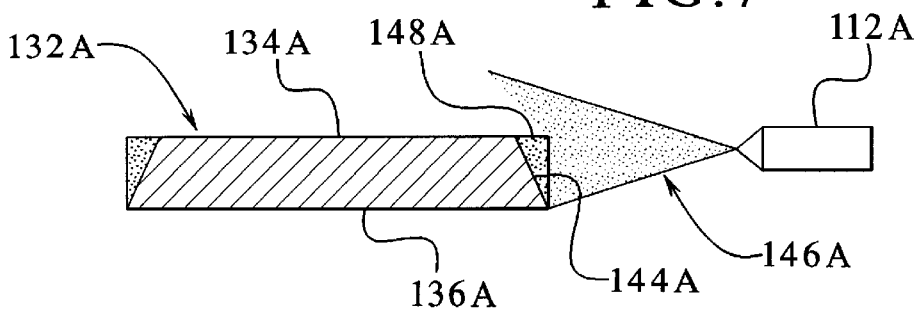
FIG. 7 is an elevational view of a part and sprayer illustrating the application of bonding material to an exterior surface of the part.

Turning now to FIG. 7, a sample part 132 having an angled or tapered surface defined by an exterior surface of the part is illustrated. Part 132A includes opposed top and bottom (or first and second) surfaces 134A and 136A, respectively, and angled portion or surface 144A.

This embodiment preferably selects sprayer 112A from a plurality of sprayers to apply bonding material 148A to the part. The sprayer is spaced a predetermined distance from and at a predetermined angle to the part. The part support rotates the part, in addition to moving the part along a line or plane with respect to the sprayer at predetermined variable rate. As the part moves, the sprayer applies bonding material to the entire angled surface thereof, preferably in one application with the sprayer which results in over spraying. Although one application is preferred, two or more applications are contemplated to eliminate overspray losses. Preferably that portion of the bonding material not applied to the part may be captured and reused. It should be appreciated that the apparatus may move the sprayer relative to the part at a predetermined fixed or variable rate, or move both the part and the sprayer with respect to each other at the same or different rates and at different angles.

Figure 8:
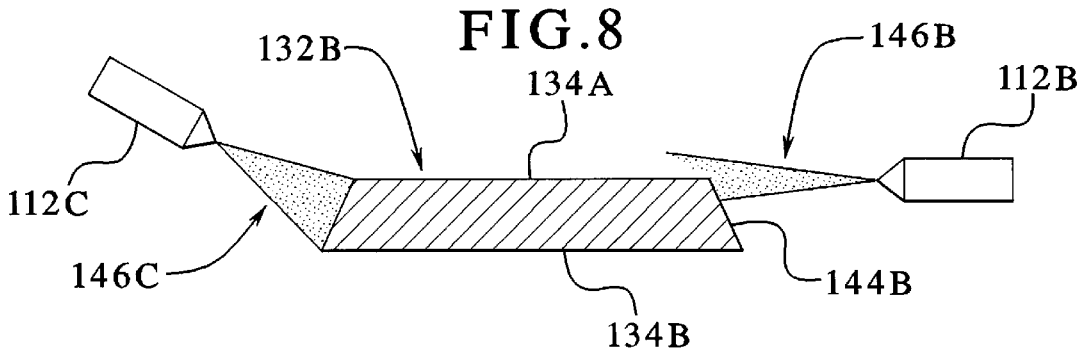
FIG. 8 is an elevational view of a part and two sprayers, illustrating the application of bonding material to an exterior surface of the part.

An alternative embodiment of the apparatus 100 and method is illustrated in FIG. 8, where two sprayers simultaneously alter or change the angled surface of the part. Preferably, the apparatus selects two sprayers from the plurality of sprayers as determined by the processor based on the part placement as determined by the sensors. The two sprayers are spaced a predetermined distance and angle to the part and each other. Each sprayer applies a predetermined amount of bonding material to the part. The first sprayer 112B, having a predetermined spray rate through a spraycone 146B, is positioned relative to that portion of the part that requires the greatest alteration (i.e., that portion that requires the greatest amount of bonding material). The second sprayer 112C, preferably having a predetermined spray rate through a spraycone 146C different (generally greater or larger) than the first sprayer, is positioned so that it applies bonding material to the entire angled surface.

As the part moves or rotates as described previously, the first sprayer 112B applies a comparatively small, predetermined amount or line of material to that portion of the angled surface requiring the greatest alteration. The second sprayer 112 applies bonding material to the entire angled surface, including the altered portion of the surface. It should be appreciated that applying a small line of material to the angled surface requiring the greatest alteration enables the second sprayer to be positioned relatively close to the part, thereby reducing overspray.

Figure 9:
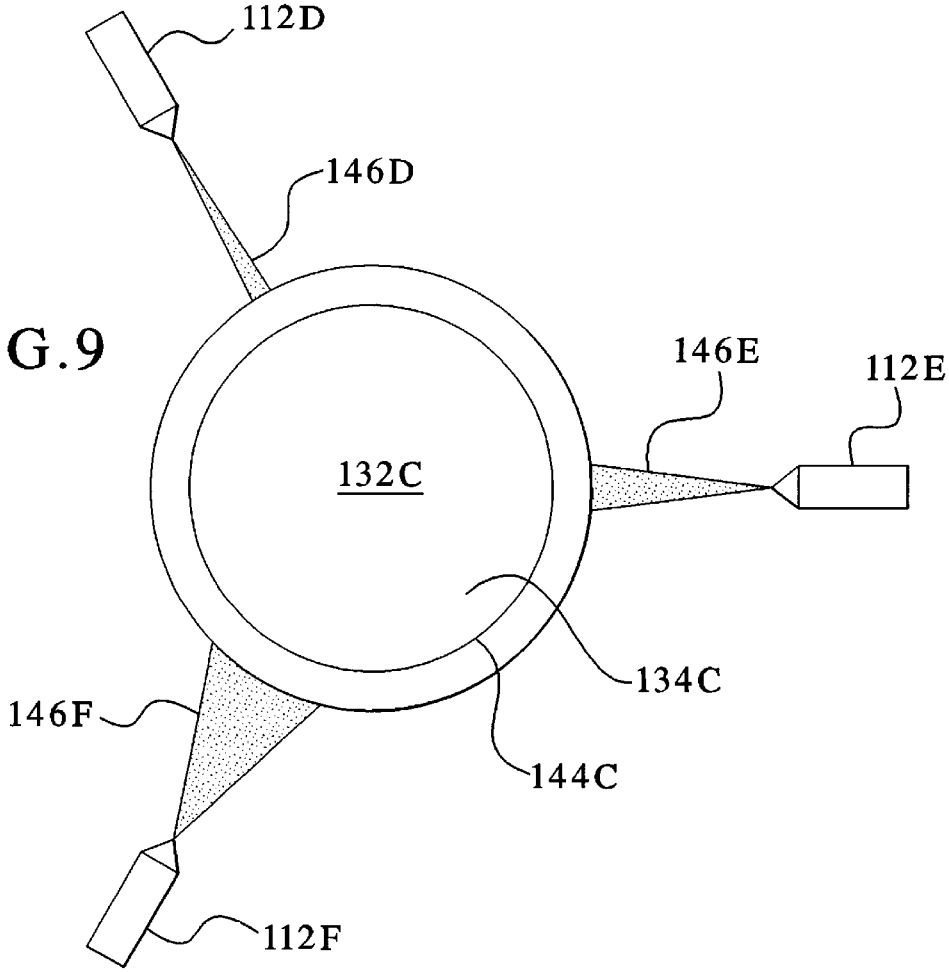
FIG. 9 is a top plan view of a part and three sprayers, illustrating the application of bonding material to an exterior surface of the part.

Yet another alternative embodiment of the apparatus 100 and method is illustrated in FIG. 9. In this embodiment, three sprayers alter or change the angled surface of the part. Again, it is contemplated that the three sprayers are selected from a plurality of sprayers, as determined by the processor in conjunction with the sensors. The three sprayers are spaced from each other and the part, where each sprayer preferably simultaneously applies a predetermined amount of bonding material to the moving part. The first sprayer 112D is positioned relative to that portion of the part 132C that requires the greatest alteration. The second sprayer 112E is positioned so that it applies bonding material to a portion of the angled surface 144C that requires a substantial amount of alteration. The third sprayer 112F is positioned so that it applies bonding material to the entire angled surface 144C.

As the part moves or rotates, the first sprayer 112D applies a comparatively small, predetermined amount or line of material to that portion of the angled surface requiring the greatest alteration. The second sprayer than applies bonding material to a relatively larger area of the angled surface, including the altered portion of the surface. The third sprayer applies bonding material to the entire angled surface.

An alternative embodiment of the apparatus and method using one sprayer 112G is illustrated in FIGS. 10A, 10B and 10C. Preferably, the apparatus positions the sprayer so that it is in spaced relationship (at a predetermined distance and angle) and only applies material to that portion of the surface 144D requiring the greatest amount of alteration. The apparatus repositions the sprayer 112G so that it applies material to a greater portion of the angled surface, and subsequently moves the sprayer to a final position, where material is applied to the entire angled surface.

In the embodiment illustrated in FIG. 10A, the apparatus positions the sprayer 112 at a first predetermined distance and angle to the angled surface. Using a first spraycone 146G, the sprayer applies a small line of bonding material 148G to only one portion such as the top third portion of the angled surface. The sprayer is then repositioned or moved to a different position and angle with respect to the part, applying material using spraycone 146H to greater portion of the angled surface, such as the top two thirds for example, forming material 148H. The sprayer is repositioned so that it applies material to the entire angled surface using a third spraycone 1461 forming material 148I. It should be appreciated that while three positions are illustrated, two or more positions are contemplated.

Other alternative embodiments are contemplated. In one alternative embodiment, the part is tapered so that the second end has a greater diameter than the first end. In this embodiment, the sprayer withdrawal speed increases as the sprayer is withdrawn. In another alternative embodiment, the sprayer moves in a plane defined parallel to the part. Additionally, the sprayer could be stationary and the support could move laterally, vertically or transversally to the sprayer while spinning. Moreover, a plurality of sprayers could be used to alter angled surfaces on both the exterior and interior of the part, either simultaneously or sequentially (i.e., the apparatus may alter the interior surface first then the exterior surface).

It should also be appreciated that the parts or the material or both could be heated to further facilitate the bonding process.

While the present invention has been described in connection with what is presently considered to be the most practical and preferred embodiments, it is to be understood that the invention is not limited to the disclosed embodiments, but on the contrary is intended to cover various modifications and equivalent arrangements included within the spirit and scope of the claims. It is thus to be understood that modifications and variations in the present invention may be made without departing from the novel aspects of this invention as defined in the claims, and that this application is to be limited only by the scope of the claims.

What is claimed is:

1. A method for changing a tapered surface of a wall of a part, said method comprising the steps of:

positioning the part and a sprayer at a predetermined distance from the part;

supplying a bonding material to said sprayer; and applying differing amounts of the bonding material from the sprayer to the tapered surface to change the tapered surface of the wall of the part to a substantially non-tapered surface.

2. The method of claim 1, which includes rotating the part.

3. The method of claim 1, which includes rotating the sprayer.

4. The method of claim 1, which includes moving the part relative to the sprayer.

5. The method of claim 1, which includes moving the sprayer relative to the part.

6. The method of claim 1, which includes moving the part at a predetermined variable rate.

7. The method of claim 1, which includes moving the part at a predetermined fixed rate.

8. The method of claim 1, which includes moving the sprayer at a predetermined variable rate.

9. The method of claim 1, which includes moving the sprayer at a predetermined fixed rate.

10. A method for applying a bonding material to a part having a wall with an angled surface to alter the angled surface, said method comprising the steps of:

moving the part;

determining the placement of the moving part using a sensor adapted to communicate with a processor;

said processor selecting at least one sprayer from a plurality of sprayers based at least partly on the placement of the moving part and the distance and angle of the sprayers relative to the moving part; and said processor causing said selected sprayer to apply differing amounts of the bonding material to the angled surface to reduce the angle of the wall of the moving part.

11. The method of claim 10, wherein the angled surface is defined by an interior wall of the part.

12. The method of claim 10, wherein the angled surface is defined by an exterior wall of the part.

13. A method for altering an angled surface of a wall of a part which defines an aperture in the part, said method comprising the steps of:

inserting a sprayer into the aperture in spaced relationship to the angled surface;

withdrawing the sprayer from the aperture at a predetermined withdrawal rate; and applying differing amounts of a bonding material to the angled surface using the sprayer to reduce the angle of the angled surface of the part.

14. The method of claim 13, which includes rotating the part.

15. The method of claim 13, which includes rotating at least a part of the sprayer.

16. The method of claim 13, which includes withdrawing the sprayer from the aperture at a variable rate.

17. The method of claim 13, which includes withdrawing the sprayer at a decreasing rate.

18. A method for altering an angled surface of a wall of part which defines an aperture in the part, said method comprising the steps of:

positioning a sprayer at a predefined distance from said angled surface of the wall of the part;

rotating the part;

causing the sprayer to apply bonding material to the angled surface of the wall of the part and moving the sprayer at a predetermined rate relative to the angled surface of the wall of the part to apply differing amounts of a bonding material to the angled surface to reduce the angle of the angled surface.

19. The method of claim 18, wherein the predetermined rate is variable.

20. The method of claim 18, wherein the step of applying differing amounts of bonding material includes applying sufficient material to make portions of the wall substantially parallel.

21. A method for changing a tapered surface of a wall of a part which defines an aperture, said method comprising the steps of:

positioning a part and a sprayer at a predefined distance from the part;

supplying a bonding material to the sprayer; and applying differing amounts of the bonding material from the sprayer to at least a portion of the tapered surface to make opposing portions of the wall of the aperture substantially parallel.

22. The method of claim 21, wherein the step of applying differing amounts of bonding material includes moving the part relative to the sprayer.

23. The method of claim 21, wherein the step of applying differing amounts of bonding material includes moving the sprayer relative to the part.

24. The method of claim 21, which includes rotating the part.

25. The method of claim 21, which includes rotating the sprayer.

26. The method of claim 21, which includes moving the sprayer at a predetermined fixed rate.

27. The method of claim 21, which includes moving the sprayer at a predetermined fixed rate.

28. The method of claim 21, which includes moving the part at a predetermined fixed rate.

29. The method of claim 21, which includes moving the part at a predetermined fixed rate.

30. A method for changing a tapered surface of a wall of a part, said method comprising the steps of:

positioning the part and a sprayer at a predetermined distance and angle relative to each other;

rotating one of the part and the sprayer;

supplying a bonding material to said sprayer;

moving one of the part and the sprayer relative to each other;

applying differing amounts of the bonding material from the sprayer to the tapered surface to make opposite sides of the tapered surface of the wall substantially parallel.

31. A method for changing a tapered interior surface of a wall of a part, said method comprising the steps of:

positioning a part and a sprayer at a predefined distance and angle relative to each other;

supplying a bonding material to the sprayer; and applying differing amounts of the bonding material from the sprayer to at least a portion of the tapered surface to make opposite sides of the wall substantially parallel.

32. The method of claim 31, which includes moving the part relative to the sprayer.

33. The method of claim 31, which includes moving the sprayer relative to the part.

34. The method of claim 31, which includes rotating the part.

35. The method of claim 31, which includes rotating the sprayer.

36. The method of claim 31, which includes moving the sprayer at a predetermined variable rate.

37. The method of claim 31, which includes moving the sprayer at a predetermined fixed rate.

38. The method of claim 31, which includes moving the part at a predetermined variable rate.

39. The method of claim 31, which includes moving the part at a predetermined fixed rate.

40. A method for changing a tapered exterior surface of a wall of a part, said method comprising the steps of:

positioning a part and a sprayer at a predefined distance from the part;

supplying a bonding material to the sprayer; and applying differing amounts of the bonding material from the sprayer to at least a portion of the tapered exterior surface to make opposite sides of the exterior surface substantially parallel.

41. The method of claim 40, which includes moving the part relative to the sprayer.

42. The method of claim 40, which includes moving the sprayer relative to the part.

43. The method of claim 40, which includes rotating the part.

44. The method of claim 40, which includes rotating the sprayer.

45. The method of claim 40, which includes moving the sprayer at a predetermined variable rate.

46. The method of claim 40, which includes moving the sprayer at a predetermined fixed rate.

47. The method of claim 40, which includes moving the part at a predetermined variable rate.

48. The method of claim 40, which includes moving the part at a predetermined fixed rate.

49. A method for changing a tapered surface of a wall of a part, said method comprising the steps of:

positioning a sprayer at a predefined distance from and at a predetermined angle relative to the part;

supplying a bonding material to the sprayer; and applying differing amounts of the bonding material from the sprayer to at least a portion of the tapered surface by moving the part relative to the sprayer or the sprayer relative to the part, to change the tapered surface of the wall of the part to a substantially non-tapered surface having opposing substantially parallel portions.

50. The method o f claim 49, which includes rotating the part.

51. The method of claim 49, which includes rotating the part.

52. The method of claim 49, which includes rotating the sprayer.

53. The method of claim 49, which includes moving the sprayer at a predetermined variable rate.

54. The method of claim 49, which includes moving the sprayer at a predetermined fixed rate.

55. The method of claim 49, which includes moving the part at a predetermined variable rate.

56. The method of claim 49, which includes moving the part at a predetermined fixed rate.

57. A method for changing an inside diameter wall or an outside diameter wall of a part which defines substantially non-parallel opposing surfaces, said method comprising the steps of:

positioning the part and a sprayer at a predetermined distance from the part;

supplying a bonding material to said sprayer; and applying differing amounts of the bonding material from the sprayer to the substantially non-parallel opposing surfaces of the wall to change the angle of the wall of the part to make said opposing surfaces substantially parallel.

* * * * *